United States Patent [19]

Bäder

[11] 4,370,523

[45] Jan. 25, 1983

[54] PROCESS AND APPARATUS FOR CONVERTING SOUND WAVES INTO DIGITAL ELECTRICAL SIGNALS

[76] Inventor: Karl O. Bäder, Lahr, Fed. Rep. of Germany

[21] Appl. No.: 267,478

[22] Filed: May 27, 1981

[30] Foreign Application Priority Data

May 28, 1980 [DE] Fed. Rep. of Germany ..... 3020247

[51] Int. Cl.[3] ..... H04R 1/20

[52] U.S. Cl. ..... 179/1 DM; 179/121 D

[58] Field of Search ..... 179/1 A, 1 DM, 121 D, 179/121, 135; 375/27, 28

[56] References Cited

U.S. PATENT DOCUMENTS

| | | | |
|---|---|---|---|
| 2,305,598 | 12/1942 | Bauer | 179/121 D |
| 2,305,599 | 12/1942 | Bauer | 179/121 D |
| 3,502,811 | 3/1970 | Schroeder | 179/1 DM |

*Primary Examiner*—G. Z. Rubinson
*Assistant Examiner*—L. C. Schroeder
*Attorney, Agent, or Firm*—Fleit & Jacobson

[57] ABSTRACT

In a process and apparatus for converting a sound wave into digital electrical signals, the sound wave is simultaneously detected by two electro-acoustic transducers spaced from each other in the direction of incidence of the sound. The transducers produce electrical signals which are compared, thereby forming a DPCM-signal in the form of a 1-bit signal.

11 Claims, 4 Drawing Figures

TRANSDUCING DPCM → PCM

TRANSDUCING PCM → ANALOG

PROCESS AND APPARATUS FOR CONVERTING SOUND WAVES INTO DIGITAL ELECTRICAL SIGNALS

BACKGROUND OF THE INVENTION

A known process for converting sound waves into digital electrical signals involves the use of an electro-acoustic transducer which is operable to produce electrical signals in dependence on the received sound waves. The signals are then translated into pulse-coded signals. Thus, in one form of such a process, a signal generator converts pressure waves into digital electrical signals, an arrangement of a plurality of sensors being activated by a scanning generator in a suitable sequence. The sensor outputs are applied to a coding matrix which produces binary coded signals. Another form of such a process involves the use of a combination of a microphone and an A-D converter, for converting the sound waves into digital signals. In both these processes, the output signal obtained is in the form of a PCM-signal (pulse code modulation signal).

In comparison, there are also other digital signal forms, for example a difference pulse code modulation signal (DPCM-signal). This gives the difference between two signal portions which occur in succession in time, in the form of a 1-bit signal, For the purposes of producing a DPCM-signal, an A-D converter is required, which is in the form of a storage means for storing a given signal portion until the next following one can be scanned. The first signal portion can then be cancelled or can be over-written with the content of the next following. For this purpose, it is necessary to operate with a high degree of electrical precision and also to use a clock signal for controlling writing into and reading out of the storage device.

When DPCM-signals are converted into PCM-signals, for example by means of a counter, in theory there is no detrimental effect in regard to quality if the following condition is fulfilled:

$$f_{DPCM}=f_{PCM}\cdot n$$

In the foregoing condition:

n denotes the number of bits per digital word in the PCM-method, $f_{PCM}$ is the scanning frequency in the PCM-method, and $f_{DPCM}$ is the scanning frequency in the DPCM-method.

With processes which are generally employed at the present time, with 16 bits per word and a scanning frequency $f_{PCM}$ of 40 kHz, the DPCM scanning rate must therefore be at least 640,000 bits/s. Because of the precision required in regard to the writing and reading operations in respect of the storage means, it will be seen that the band width required for the above-mentioned clock must be substantially higher.

SUMMARY OF THE INVENTION

An object of the present invention is to provide a process and apparatus for converting sound into digital electrical signals, which do not suffer from the shortcomings of the above-discussed arrangements.

A further object of the invention is to provide a process and apparatus for converting sound waves into digital electrical signals, without requiring an A-D converter for producing a DPCM-signal.

A still further object of the invention is to provide a process and apparatus for converting sound waves into digital electrical signals, without requiring a clock or a storage means.

Another object of the invention is to provide a microphone assembly having a directional characteristic which is adapted to be controlled.

These and other objects are achieved by the present invention, which provides that the sound waves to be converted are continuously simultaneously detected by two electro-acoustic transducers which are disposed at a spacing from each other in the direction of propagation of the sound. From the comparison of each two electrical signals which respectively correspond to two simultaneously detected sound waves, there is formed a DPCM-signal in the form of a 1-bit signal. The DPCM-signal indicates whether the amplitude or velocity of the sound waves is increasing or decreasing. The difference signal is scanned at a rate corresponding to the reciprocal of the time, in seconds, required for the sound wave to go from the first transducer to the second, as viewed in the direction of incidence of the sound.

The apparatus comprises a housing having first and second transducers arranged therein at a spacing from each other in the direction of incidence of the sound. A comparator is connected to the outputs of the transducers, optionally by way of amplifiers. The housing is open at one end or side, to define a given direction of incidence of the sound, with an acoustic sump means at the other end or side of the housing, to prevent internal sound reflection within the housing.

In the present invention therefore, two identical acoustic transducers may be arranged, for example in a microphone housing, at a precisely determined distance from each other. As the speed of propagation of sound in air is known, the distance in terms of space between the two transducers may be used to define a spacing in respect of time, which is used for determining the difference between two successive signal portions. That difference can be continuously measured and is for example positive as long as the strength or intensity of the sound signal is increasing and negative when the curve has gone beyond its peak. As the spacing between the two transducers has a frequency-determining effect, no clock signal is required. In addition, the storage means which is otherwise required in the previously discussed process can also be omitted as it is possible to provide for continuous measurement of the above-mentioned difference, as already stated.

The electro-acoustic transducers may be for example pressure sensors, diaphragms or any other suitable members.

By using a housing which is open at least at one half side, the incidence of sound from the rear is prevented, and the arrangement of an acoustic sump means, at a position opposite to the opening in the housing, prevents reflections from reaching the transducers from the opposite direction.

The output voltages of the electro-acoustic transducers are applied, by way of optionally interposed amplifier means, to a comparator, the output of which directly produces a DPCM-signal which indicates whether the amplitude of the sound wave, or the velocity which is the first derivative of the amplitude in respect of time, increases or decreases. The output of the comparator may have a digital device connected thereto, with a scanning rate which corresponds to the reciprocal value of the time, in seconds, which is required for the sound wave to pass from the first transducer to the second transducer, as viewed in the direction of propagation of the sound. In this way, it is possible to evaluate sound signals which come in directly from the front. In this case, a hypercardioid characteristic is produced. This alters if the scanning rate is slightly altered. In this respect it is possible to achieve remote control in respect of the directional characteristic of the arrangement by altering the scanning rate in the digital device, which can be for example a digital mixer desk.

DESCRIPTION OF THE PREFERRED EMBODIMENT

Figure 1:
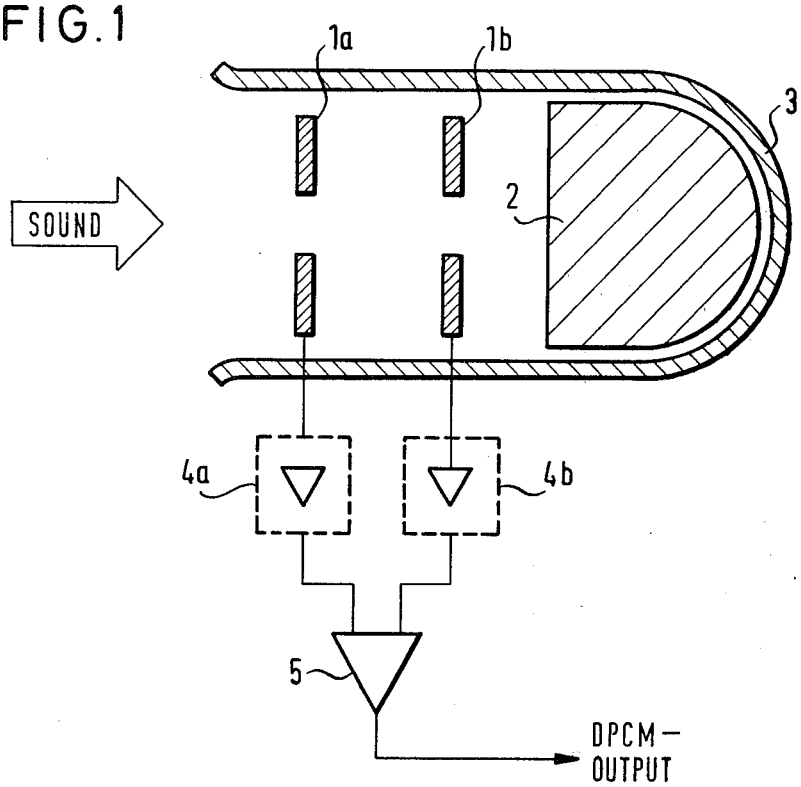
FIG. 1 shows a microphone arrangement comprising two transducers.

Referring to FIG. 1, shown therein is a microphone arrangement comprising a housing 3 in which first and second electro-acoustic transducers 1*a* and 1*b* are arranged, at a given spacing from each other, as viewed in the direction of incidence or propagation of the sound wave. The transducers may be for example in the form of pressure sensors, diaphragm members or other suitable components. The housing is open at one end or side so that sound waves act on the electro-acoustic transducers 1*a* and 1*b* from that end or side, thus with a defined direction of incidence. Disposed at the closed end or side of the housing 3, in the opposite direction to the opening into the housing, is an electro-acoustic sump means 2 for preventing reflective phenomena at the inside of the housing.

The outputs of the electro-acoustic transducers 1*a* and 1*b* are connected to the inputs of a comparator 5, possibly by way of amplifiers as indicated at 4*a* and 4*b*. The comparator 5 may be in the form of an integrated analog amplifier with a push-pull input. The signals to be compared are applied to the inverting and the non-inverting inputs respectively and the amplifier assembly is operated without feedback. Depending on which of the two inputs predominates, the output of the comparator correspondingly jumps back and forth between the values of the maximum positive and negative supply voltages respectively. The output of the comparator is a DPCM-signal in the form of a 1-bit signal.

Figure 2:
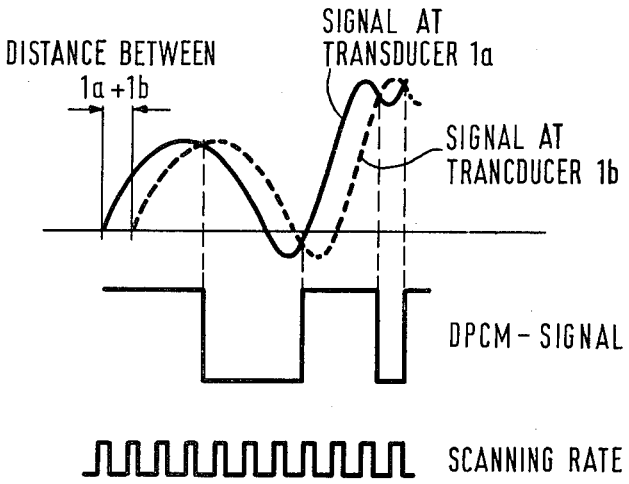
FIG. 2 shows scale views illustrating production of the DPCM-signal and scanning thereof.

FIG. 2 is a diagrammatic view of the two output signals of the electro-acoustic transducers 1*a* and 1*b* for an incident sound wave, showing the distance in time between the transducer output signal curves. The distance in respect of time between the two output signals is determined by the distance in respect of space between the two transducers 1*a* and 1*b* in the housing 3. Depending on whether the difference between the two output signals is negative or positive, a corresponding DPCM-signal which is also diagrammatically shown in FIG. 2, occurs at the output of the comparator 5. A suitable comparator is for example an amplifier of type LM 311 as that amplifier has a low offset error at the input.

Figure 3:
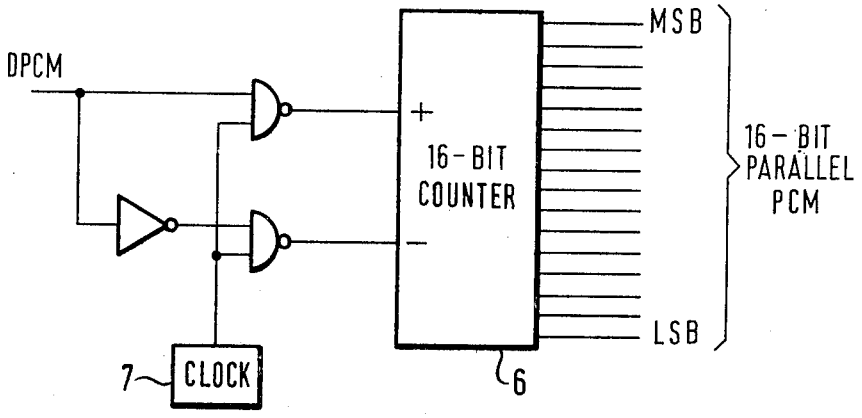
FIG. 3 shows apparatus for transducing or converting the DPCM-signal into a PCM-signal.

Subsequent conversion or transducing of the DPCM-signal into a PCM-signal may be effected for example by means of a 16-bit counter 6, as shown in FIG. 3. The incoming DPCM-signal is scanned by means of a clock 7 at a given scanning rate, which is diagrammatically shown in FIG. 2. If the scanning rate precisely corresponds to the reciprocal value of that time, in seconds, which the sound wave requires to go between the two transducers, the resulting directional characteristic of the microphone assembly shown in FIG. 1 is such that sound signals which arrive directly from the front are evaluated. As already mentioned hereinbefore, a remote control in respect of the directional characteristic may be achieved by altering the scanning rate. The 16-bit counter counts upward by a step whenever the DPCM-signal includes a one and the counter counts downwards by a step whenever the DPCM-signal includes a nought. As the counter 6 has 65536 possible output configurations, it is possible to achieve the required fine stepping or graduation in respect of the output signal, by virtue of the high bit frequency in the DPCM-signal. The counter 6 has 16 parallel outputs which supply the PCM-signal with 16 bits per word.

Figure 4:
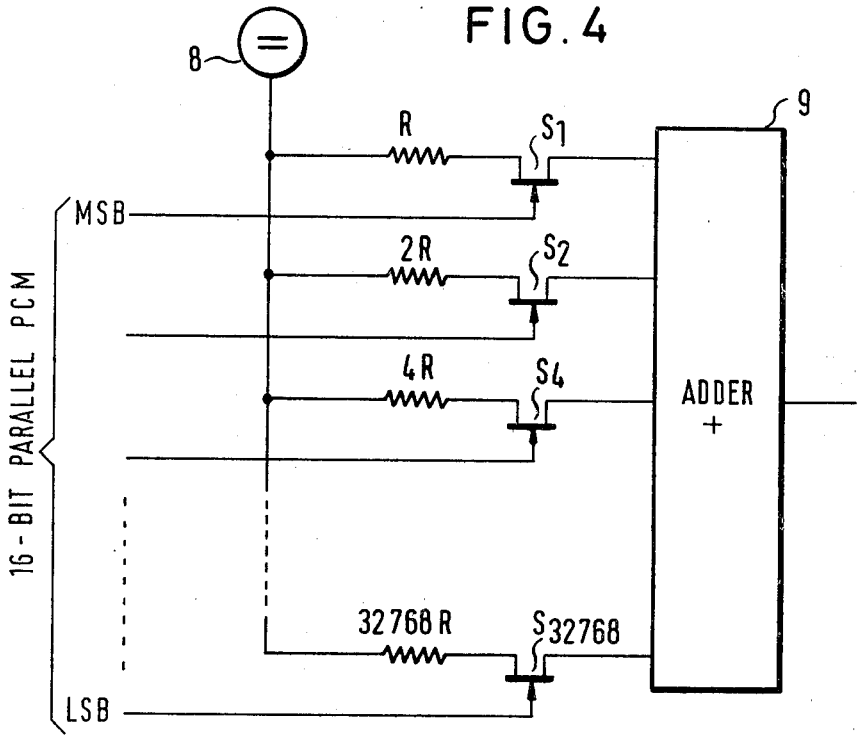
FIG. 4 shows apparatus for transducing or converting the PCM-signal into an analog signal.

Referring to FIG. 4, it will be seen that the above-mentioned PCM-signal may be converted into an analog signal by means of the apparatus shown therein. For this purpose, the digital signal directly actuates 16 different current paths which are related to each other as 1:2:4 . . . :32768. For this purpose, the arrangement includes suitably sized resistors R, 2R, 4R . . . 32768R in parallel current paths, which are connected to a d.c. source 8. The current paths are also connected by way of electronic switches S1, S2. S4 . . . S32768 which are directly actuated by the counter outputs, to an adder 9, the output of which supplies the desired analog signal. In this way, direct setting of an analog signal is achieved, by means of the digital signal, for each scanning value.

Various modifications may be made in the above-described process and apparatus, without thereby departing from the scope and spirit of the present invention.

I claim:

1. A process for converting sound waves into digital electrical signals wherein the sound waves are continuously simultaneously detected by first and second electro-acoustic transducers which are disposed at a spacing from each other in the direction of incidence of the sound and which thereby produce electrical signals in dependence on the received sound, and a respective difference pulse code modulation signal in the form of a 1-bit signal is formed from the comparison of each two electrical signals which respectively correspond to two said simultaneously detected sound waves.

2. A process as set forth in claim 1 wherein the difference pulse code modulation signal indicates whether the amplitude or velocity of the sound waves is increasing or decreasing.

3. A process as set forth in claim 1 wherein the difference pulse code modulation signal is scanned at a scanning rate which corresponds to the reciprocal value of the time in seconds required for the sound wave to pass from the first transducer to the second transducer, as viewed in the direction of propagation of the sound.

4. A process as set forth in claim 3 wherein said transducers form a microphone means and the directional characteristic of said microphone means is adapted to be altered by alteration of said scanning rate.

5. A process as set forth in claim 1 wherein said DPCM-signal is converted into a PCM-signal and the PCM-signal is converted into an analog signal.

6. Apparatus for converting sound waves into digital electrical signals, comprising a housing, first and second electro-acoustic transducers disposed in the housing at a spacing from each other and adapted to produce electrical output signals in dependence on sound waves simultaneously detected by said transducers, and a comparator means having inputs connected to the outputs of the first and second transducers.

7. Apparatus as set forth in claim 6 including a digital device connected to the output of the comparator means and having a scanning rate which corresponds to the reciprocal value of the time in seconds required for the sound wave to go from the first transducer to the second transducer, as viewed in the direction of propagation of the sound.

8. Apparatus as set forth in claim 6 wherein said housing is open at one side and including an acoustic sump means in the housing at a position remote from the opening.

9. Apparatus as set forth in claim 6 and further including amplifier means connected between the outputs of the transducers and the inputs of the comparator means.

10. Apparatus as set forth in claim 6 and further including means for converting the output DPCM-signal of the comparator means into a PCM-signal.

11. Apparatus as set forth in claim 10 and further including means for converting said PCM-signal into an analog signal.

* * * * *